US007422444B1

(12) United States Patent
Johnescu

(10) Patent No.: US 7,422,444 B1
(45) Date of Patent: Sep. 9, 2008

(54) ORTHOGONAL HEADER

(75) Inventor: Douglas Michael Johnescu, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/680,210

(22) Filed: Feb. 28, 2007

(51) Int. Cl.
*H01R 12/00* (2006.01)

(52) U.S. Cl. ..... 439/78; 439/608

(58) Field of Classification Search ..... 439/65, 439/78, 108, 608, 701
See application file for complete search history.

(56) References Cited

U.S. PATENT DOCUMENTS

| | | | | |
|---|---|---|---|---|
| 2,664,552 | A | 12/1953 | Ericsson et al. | 339/192 |
| 3,115,379 | A | 12/1963 | McKee | 439/290 |
| 3,827,005 | A | 7/1974 | Friend | 339/258 |
| 4,030,792 | A | 6/1977 | Fuerst | 339/17 |
| 4,482,937 | A | 11/1984 | Berg | |
| 4,898,539 | A | 2/1990 | Glover et al. | 439/81 |
| 4,900,271 | A | 2/1990 | Colleran et al. | 439/595 |
| 5,004,426 | A | 4/1991 | Barnett | 439/82 |
| 5,046,960 | A | 9/1991 | Fedder | |
| 5,575,688 | A | 11/1996 | Crane, Jr. | 439/660 |
| 5,634,821 | A | 6/1997 | Crane, Jr. | 439/660 |
| 5,637,019 | A | 6/1997 | Crane, Jr. et al. | 439/677 |
| 5,980,321 | A | 11/1999 | Cohen et al. | 439/608 |
| 6,116,926 | A | 9/2000 | Ortega et al. | 439/108 |
| 6,179,663 | B1 | 1/2001 | Bradley et al. | 439/608 |
| 6,227,882 | B1 | 5/2001 | Ortega et al. | 439/101 |
| 6,293,827 | B1 | 9/2001 | Stokoe | 439/608 |
| 6,299,483 | B1 | 10/2001 | Cohen et al. | 439/608 |
| 6,302,711 | B1 | 10/2001 | Ito | 439/83 |
| 6,328,602 | B1 | 12/2001 | Yamasaki et al. | 439/608 |
| 6,375,478 | B1 | 4/2002 | Kikuchi | |
| 6,379,188 | B1 | 4/2002 | Cohen et al. | 439/608 |
| 6,414,248 | B1 | 7/2002 | Sundstrom | |
| 6,464,529 | B1 | 10/2002 | Jensen et al. | |
| 6,503,103 | B1 | 1/2003 | Cohen et al. | |
| 6,506,076 | B2 | 1/2003 | Cohen et al. | 439/608 |
| 6,540,522 | B2 | 4/2003 | Sipe | 439/61 |
| 6,551,140 | B2 | 4/2003 | Billman et al. | |
| 6,572,409 | B2 | 6/2003 | Nitta et al. | 429/608 |
| 6,592,381 | B2 | 7/2003 | Cohen et al. | |
| 6,672,907 | B2 | 1/2004 | Azuma | 439/682 |
| 6,692,272 | B2 | 2/2004 | Lemke et al. | 439/108 |
| 6,695,627 | B2 | 2/2004 | Ortega et al. | 439/78 |

(Continued)

OTHER PUBLICATIONS

U.S. Appl. No. 60/839,071, filed Aug. 21, 2006, Minich.

(Continued)

*Primary Examiner*—Khiem Nguyen
(74) *Attorney, Agent, or Firm*—Woodcock Washburn LLP

(57) ABSTRACT

An electrically-conductive contact for an electrical connector is disclosed. Such a contact may include a lead portion, an offset portion extending from an end of the lead portion, and a mounting portion that may extend from a distal end of the offset portion. The lead portion and the distal end of the offset portion may each define an imaginary plane that may intersect at a non-zero, acute angle. An electrical connector that is suitable for orthogonal connector applications may include a connector housing securing two such electrical contacts. The distance between the respective mounting portions of the two such contacts may be defined independently of the contact pitch.

14 Claims, 12 Drawing Sheets

U.S. PATENT DOCUMENTS

| | | | | |
|---|---|---|---|---|
| 6,736,664 | B2 | 5/2004 | Ueda et al. | 439/423 |
| 6,746,278 | B2 | 6/2004 | Nelson et al. | 439/608 |
| 6,749,439 | B1 | 6/2004 | Potter et al. | 439/65 |
| 6,764,341 | B2 | 7/2004 | Lappoehn | 439/608 |
| 6,808,420 | B2 | 10/2004 | Whiteman, Jr. et al. | 439/608 |
| 6,843,686 | B2 | 1/2005 | Ohnishi et al. | 439/608 |
| 6,848,944 | B2 | 2/2005 | Evans | |
| 6,851,980 | B2 | 2/2005 | Nelson et al. | 439/608 |
| 6,893,686 | B2 | 5/2005 | Egan | 427/496 |
| 6,913,490 | B2 | 7/2005 | Whiteman, Jr. et al. | 439/608 |
| 6,918,789 | B2 | 7/2005 | Lang et al. | 439/608 |
| 6,945,796 | B2 | 9/2005 | Bassler et al. | |
| 6,979,215 | B2 | 12/2005 | Avery et al. | |
| 6,981,883 | B2 | 1/2006 | Raistrick et al. | 439/74 |
| 6,994,569 | B2 | 2/2006 | Minich et al. | |
| 7,021,975 | B2 | 4/2006 | Lappohn | 439/733.1 |
| 7,094,102 | B2 | 8/2006 | Cohen et al. | 439/608 |
| 7,108,556 | B2 | 9/2006 | Cohen et al. | 439/608 |
| 7,331,802 | B2 | 2/2008 | Rothermel et al. | |
| 7,331,830 | B2 | 2/2008 | Minich | |
| 2003/0116857 | A1 | 6/2003 | Taniguchi et al. | |
| 2004/0224559 | A1 | 11/2004 | Nelson et al. | |
| 2004/0235321 | A1 | 11/2004 | Mizumura et al. | 439/92 |
| 2005/0032401 | A1 | 2/2005 | Kpbayashi | 439/76.2 |
| 2005/0170700 | A1 | 8/2005 | Shuey et al. | 439/701 |
| 2005/0196987 | A1 | 9/2005 | Shuey et al. | 439/108 |
| 2005/0215121 | A1 | 9/2005 | Tokunaga | 439/608 |
| 2005/0227552 | A1 | 10/2005 | Yamashita et al. | 439/862 |
| 2006/0024983 | A1 | 2/2006 | Cohen et al. | 439/61 |
| 2006/0068641 | A1 | 3/2006 | Hull et al. | 439/608 |
| 2006/0073709 | A1 | 4/2006 | Reid | 439/65 |
| 2006/0228912 | A1 | 10/2006 | Morlion et al. | 439/65 |
| 2006/0232301 | A1 | 10/2006 | Morlion et al. | 326/126 |

OTHER PUBLICATIONS

U.S. Appl. No. 60/846,711, filed Sep. 22, 2006, Morlion et al.

U.S. Appl. No. 11/367,784, filed Mar. 3, 2006, Minich.

Cartier, M. et al., "Optimized Signal Path for Orthogonal System Architectures". DesignCon. 2005, 24 pages.

ORTHOGONAL HEADER

BACKGROUND

In circuit board connector applications where adjacent lead contacts form a signal pair, the spacing between the contact mounts at the circuit board may affect signal integrity. For example, the spacing may affect skew, cross-talk, and impedance.

In some orthogonal applications, the contact mounts for a signal pair may be oriented at a 45° angle to the contacts. For example, in an orthogonal mid-plane architecture, two daughter boards, orthogonal to each other, may each connect to each side of a mid-plane circuit board. The connectors may mount to the mid-plane through common vias. Because each connector may provide a 45° difference between the contact mounts and the contacts, the connectors that mate to the daughter boards may be 90° rotated relative to each other. For each connector to achieve this 45° angle, each lead of a signal pair may include an transverse offset, or bend, in opposite directions such that the transverse offset matches the contact pitch.

Generally, connectors are manufactured in families with compatible geometry such as common contact pitch. Where the transverse offset matches the contact pitch, a single connector family lacks the flexibility to define a via spacing specific to the signal integrity and physical design requirements of different applications. Thus, there is a need for an orthogonal connector where the spacing between the contact mounts may be varied independently of the contact pitch.

SUMMARY

An electrically-conductive contact for an electrical connector is disclosed which may include a lead portion, an offset portion extending from an end of the lead portion, and a mounting portion that may extend from a distal end of the offset portion. The lead portion and the distal end of the offset portion may each define an imaginary plane. The two imaginary planes may intersect at a non-zero, acute angle. The offset portion may be curved.

An electrical connector is disclosed which may include a connector housing securing two electrical contacts. Each electrical contact may include a lead portion, an offset portion extending from an end of the lead portion, and a mounting portion that may extend from a distal end of the offset portion. The lead portion and the distal end of the offset portion may each define an imaginary plane. The two imaginary planes may intersect. The lead portions of each contact may be aligned in an imaginary contact plane. Each mounting portion may be positioned such that the intersection of the contact plane and an imaginary line extending between the distal tips of each mounting portion defines a substantially 45° angle as measured normal to the contact plane an imaginary line.

The distance between the respective mounting portions may be selected to match the impedance of a complementary electrical independent of the distance between the respective lead portions. The connector housing may define a mounting face for mounting to a circuit board and the respective offset portions may be substantially flush with the mounting face.

DETAILED DESCRIPTION

Figure 1A:
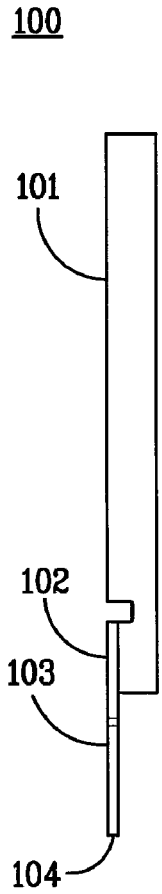
FIGS. 1A and 1B depict an illustrative electrical contact in front and side views, respectively.
Figure 1B:
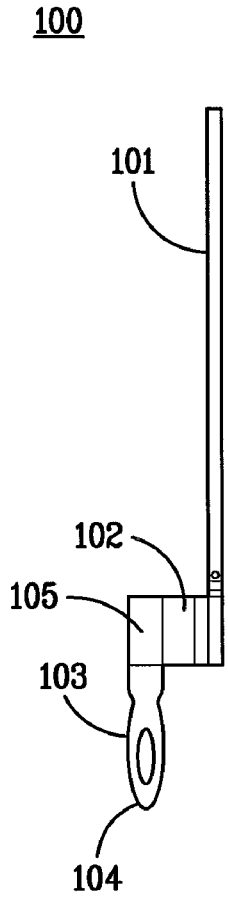

FIGS. 1A and 1B depict an illustrative electrical contact 100 in front and side views, respectively. The contact may include a lead portion 101 connected to an offset portion 102. The contact may include a mounting portion 103 also connected to the offset portion 102. The mounting portion 103 may define a distal tip 104. The contact 100 may be made of an electrical conductive material such as metal. The contact 100 may be manufactured by stamping and bending metal into the desired shape.

The lead portion 101 may extend from one end of the offset portion 102. The mounting portion 103 may extend from the other end of the offset portion 102. The lead portion 101 and the mounting portion 103 may extend in opposite directions.

The lead portion 101 and the mounting portion 103 may each define a longitudinal axis. The offset portion 102 may define the distance between the two axes. The offset portion 102 may be straight or curved. For example, the length and the shape of the offset portion 102 may define the distance and relative position of the two axes.

Further, the offset portion 102 may extend from the end of the lead portion 101 in a first direction orthogonal to the longitudinal axis of the lead portion 101. The offset portion 102 may extend from the mounting portion 103 in a second direction orthogonal to the longitudinal axis of the mounting portion.

The mounting portion 103 may be suitable for mounting to a substrate, such as a circuit board, for example. For example, the mounting portion 103 may be an eye-of-the-needle configuration suitable for securing into vias within the circuit board. In another embodiment, the mounting portion 103 may be suitable for a ball grid array (BGA). When mounted to a circuit board, the offset portion 102 of the contact 100 may abut the upper surface of the circuit board.

The lead portion 101 may be suitable for establishing an conductive connection with a complementary contact. For example, the lead portion 101 may be a plug contact or a receptacle contact.

The lead portion 101 and the mounting portion 103 may each define an imaginary plane. The two imaginary planes may intersect. In one embodiment, the two imaginary planes may intersect at a right angle. In another embodiment, the two imaginary planes may intersect at a non-right angle. The non-right angle may be an acute angle or an obtuse angle.

Generally, two instances of the contact 100 may be arranged in a signal pair in an electrical connector. While the orientation of the respective mounting portions relative to the respective lead portions may be suitable for an orthogonal application, the distance between the respective mounting portions may be selected independent of the distance between the respective lead portions. For example, the signal pair may be employed in narrow, wide, or variable configurations.

Figure 2A:
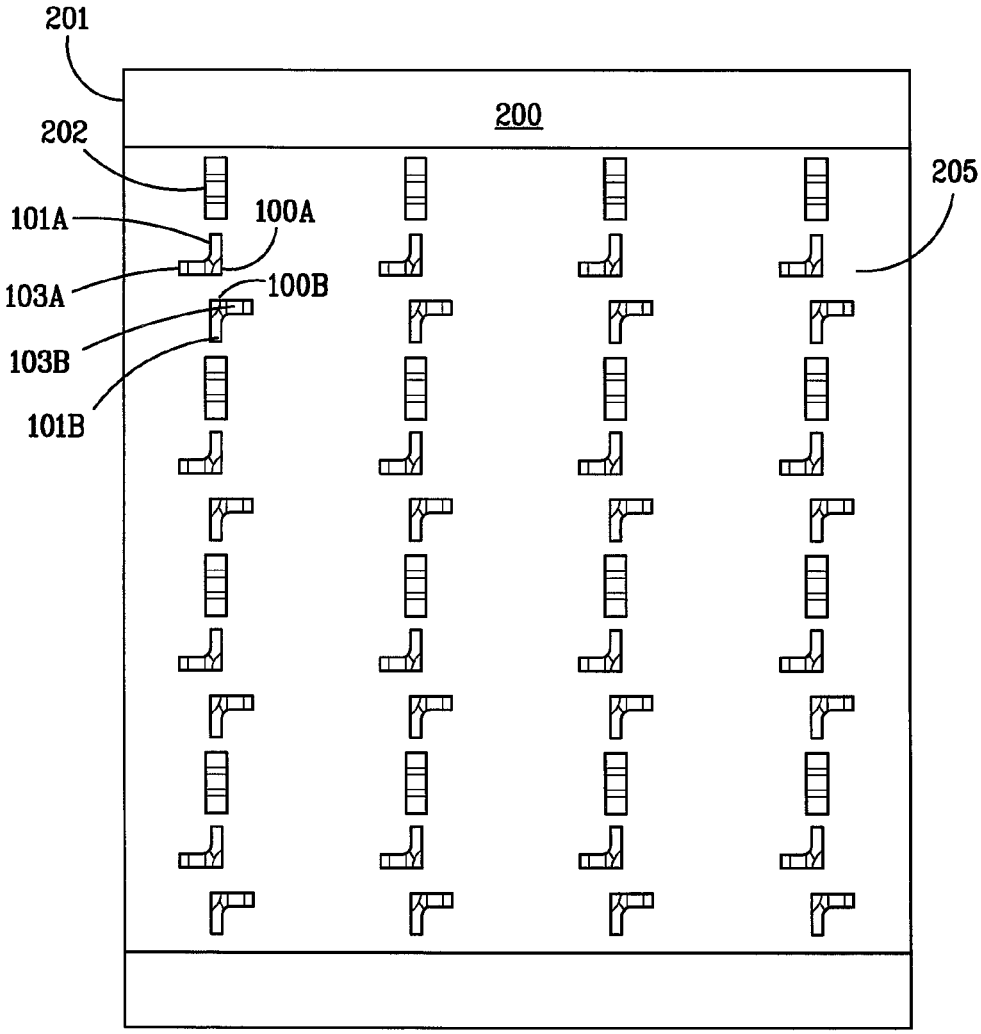
FIGS. 2A-C depict the bottom of an illustrative electrical connector in a narrow configuration in bottom, close-up, and isometric views, respectively.
Figure 2B:
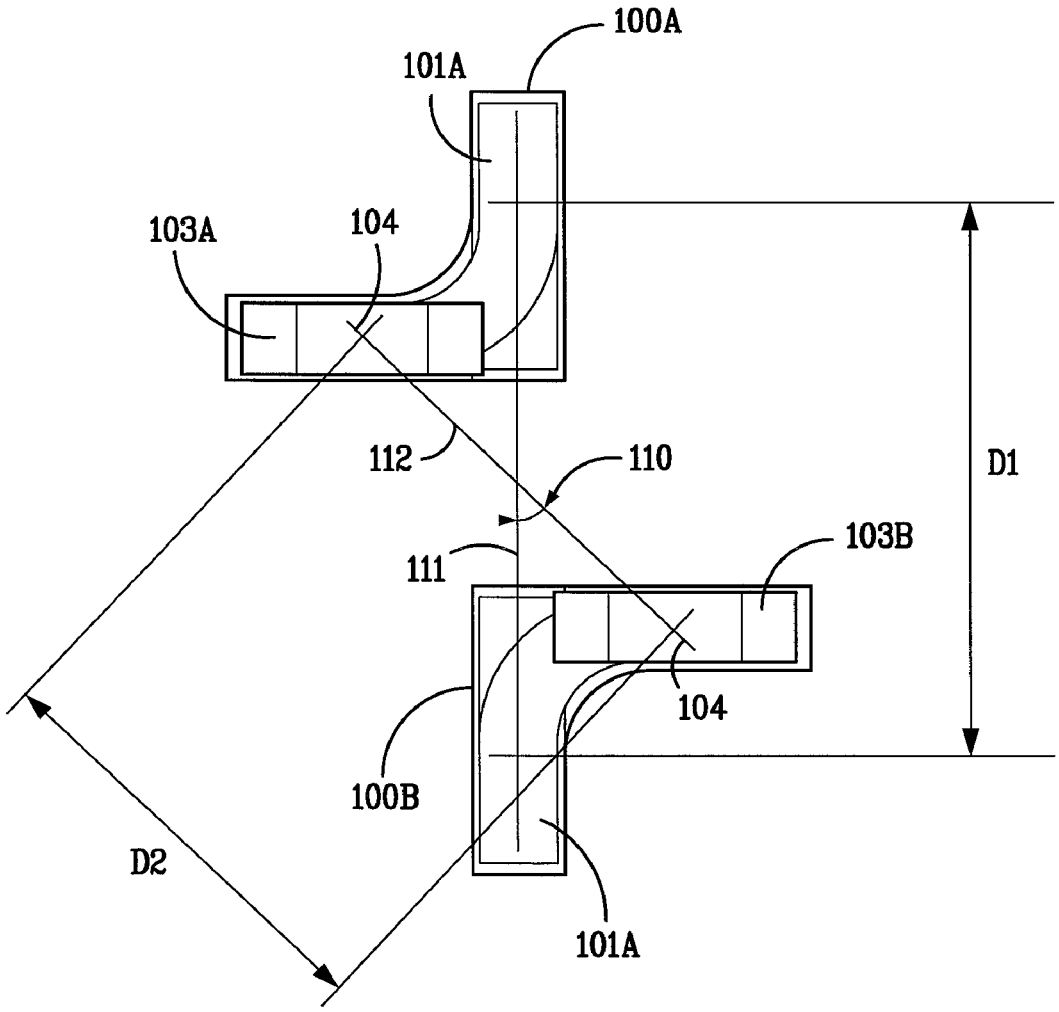
Figure 2C:
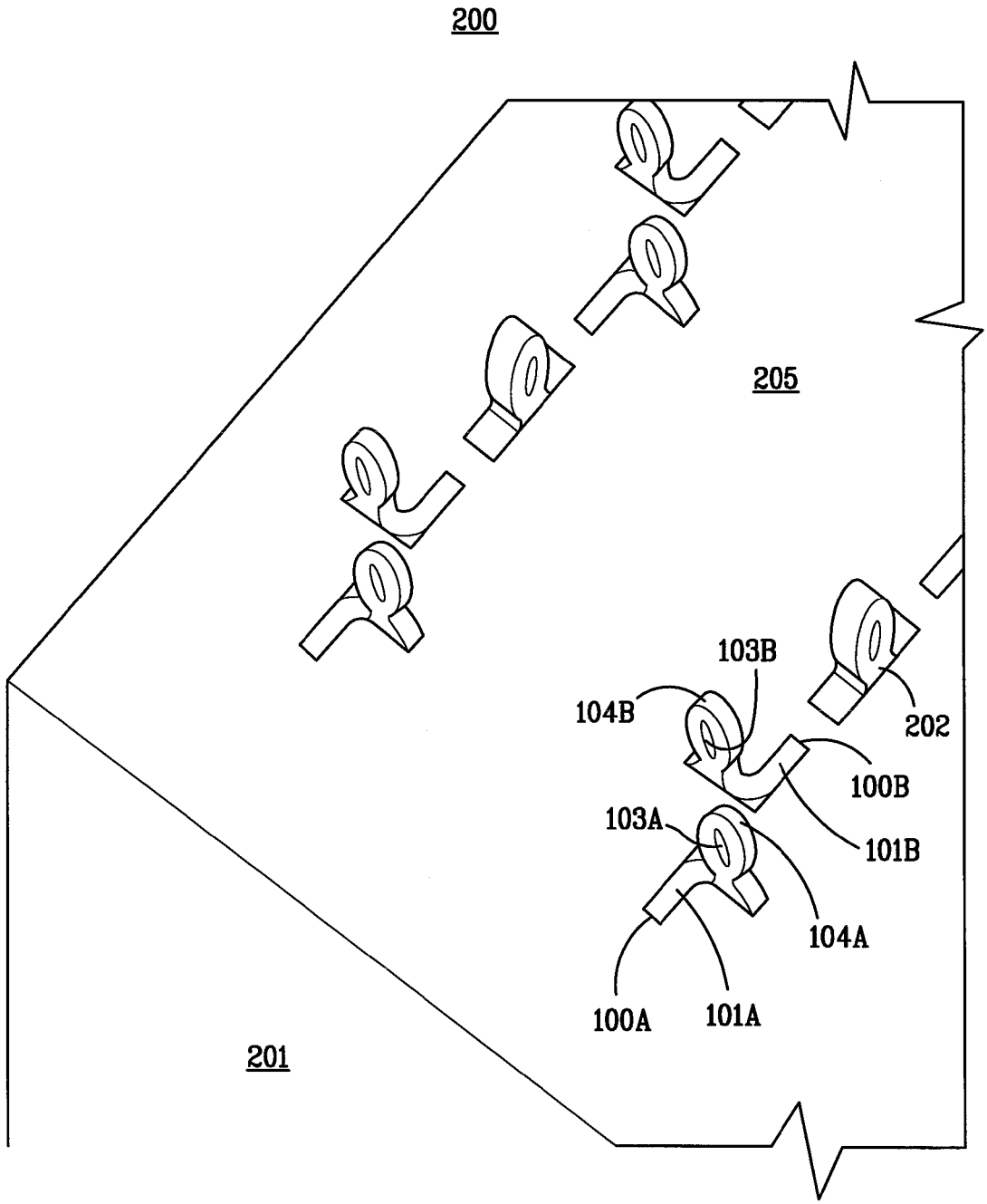

FIGS. 2A-C depict the bottom of an illustrative electrical connector 200 in a narrow configuration in bottom, close-up, and isometric views, respectively. Each contact 100A-B within the signal pair may face toward each other. For example, the first contact 100A of the signal pair may be rotated 180° with respect to the second contact 101B of the signal pair such that their respective mounting portions 103A-B are between the respective lead portions 101A-B in a narrow configuration.

The connector 200 may be suitable for an orthogonal application. The connector 200 may include signal contacts 100A-B and ground contacts 202 secured within a connector housing 201. The connector housing 201 may be made of any non-conductive material. For example, the housing 201 may be made from plastic. The connector housing 201 may have a mounting side and a mating side. The mating side (not shown) may be suitable for engaging a complementary connector. The mounting side 205 may be suitable for mounting the connector 200 to a circuit board. For example, the mounting portion 103A-B of each contact 100A-B may extend through the mounting side 205 of the connector housing 201. The offset portion (not shown) of each contact 100A-B may be flush to the mounting side 205 of the connector housing 201. When the connector 200 is mounted to the circuit board, the offset portion (not shown) of each contact 100A-B may be flush to the upper surface of the circuit board better maintaining impedance through the connector and reducing the amount of impedance mismatch.

The lead portion 101A-B of each signal contact 100A-B and each ground contact 202 may be arranged in rows and columns. Each signal contact 100A-B may be grouped into differential signal pairs. The distance between the lead portions 101A-B of each contact may be defined as the contact pitch.

Suitable for an orthogonal application, the connector 200 may enable the lead portion 101A-B of each contact 100A-B to be oriented at a substantially 45° angle from the respective mounting portions 103A-B. For example, an imaginary contact plane 111 may align the lead portion 101A of the first contact 100A and the lead portion 101B of the second contact 100B. An imaginary line 112 may extend from the distal tip 104A of the mounting portion 103A of the first contact 100A to distal tip 104B of the mounting portion 103B of the second contact 100B. The contact plane and the imaginary line may interest at an angle 110. The angle 110 measured normal to the contact plane may be substantially 45°. The angle may be substantially 45° within manufacturing tolerance.

Distance D1 may be defined as the distance measured along the contact plane between the center of the lead portion 101A of the first contact 100A and the center of the lead portion 101B of the second contact 100B. Distance D1 may measure the contact pitch as measured center-to-center.

Distance D2 may be defined as the length of the imaginary line 112. Distance D2 may be selected independent of distance D2 such that the angle 110 is maintained. Thus, the distance D2 may be selected according to signal integrity and/or physical design requirements, while maintaining the geometry suitable for orthogonal applications. Because distance D2 may be selected independent of distance D1, connectors of the same family, where contact pitch is defined for the connector family, may be manufactured for specific applications such that distance D2 may be selected to match the impedance of a specific complementary electrical device. In the configuration shown, D2 may represent the minimum hole-to-hole spacing for an orthogonal application with a D1 contact pitch. Such a configuration may allow for lower crosstalk, lower impedance, and wider area for trace routing.

Figure 3:
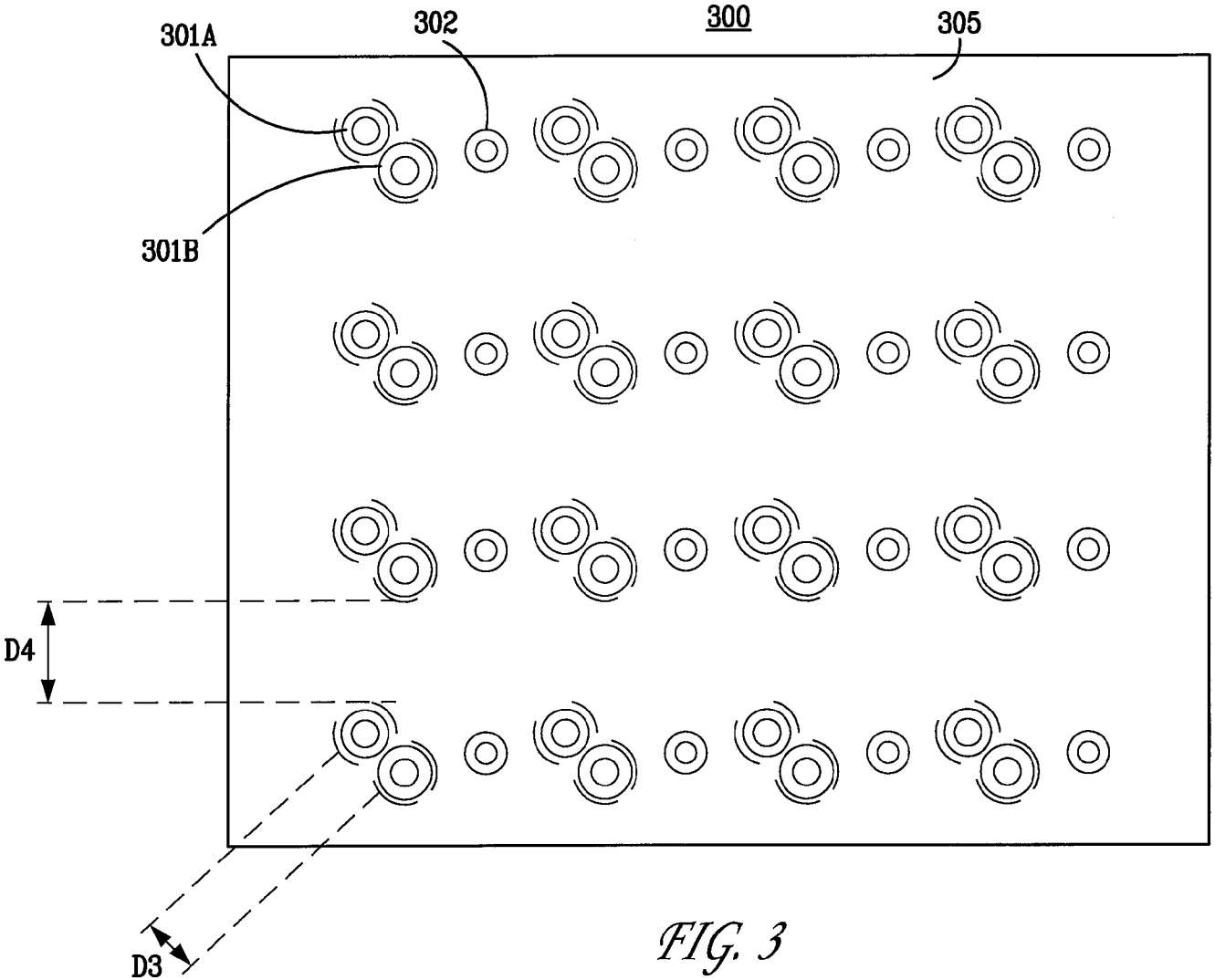
FIG. 3 depicts a illustrative circuit board layout for a narrow configuration.

FIG. 3 depicts a illustrative circuit board layout 300 for a narrow configuration. Vias 301A-B, 302 may be holes in the circuit board 305 oriented for mounting connector 200. For example, via 302 may be a hole within the circuit board 305 that receives the mounting portion of the ground contact 202, and via 301A-B may be a hole within the circuit board 305 that receives mounting portion 103A-B of the signal contacts 100A-B.

The circuit board layout 300 may define a distance D3 between vias 301A-B. Distance D3 may match the distance D2. It may be desirable to select D3 on the basis of signal integrity. For example, it may be desirable to select D3 on the basis of impedance matching.

The circuit board layout 305 may define a distance D4 between rows of vias 301A-B. Distance D4 may provide a width of circuit board that may be used for conductive traces (not shown). It may be desirable to select distance D4 to ensure adequate physical space for conductive traces. Accordingly, design requirements that influence distance D3 and distance D4 may reflect various implementations for distance D2 of the electrical connector.

Figure 4A:
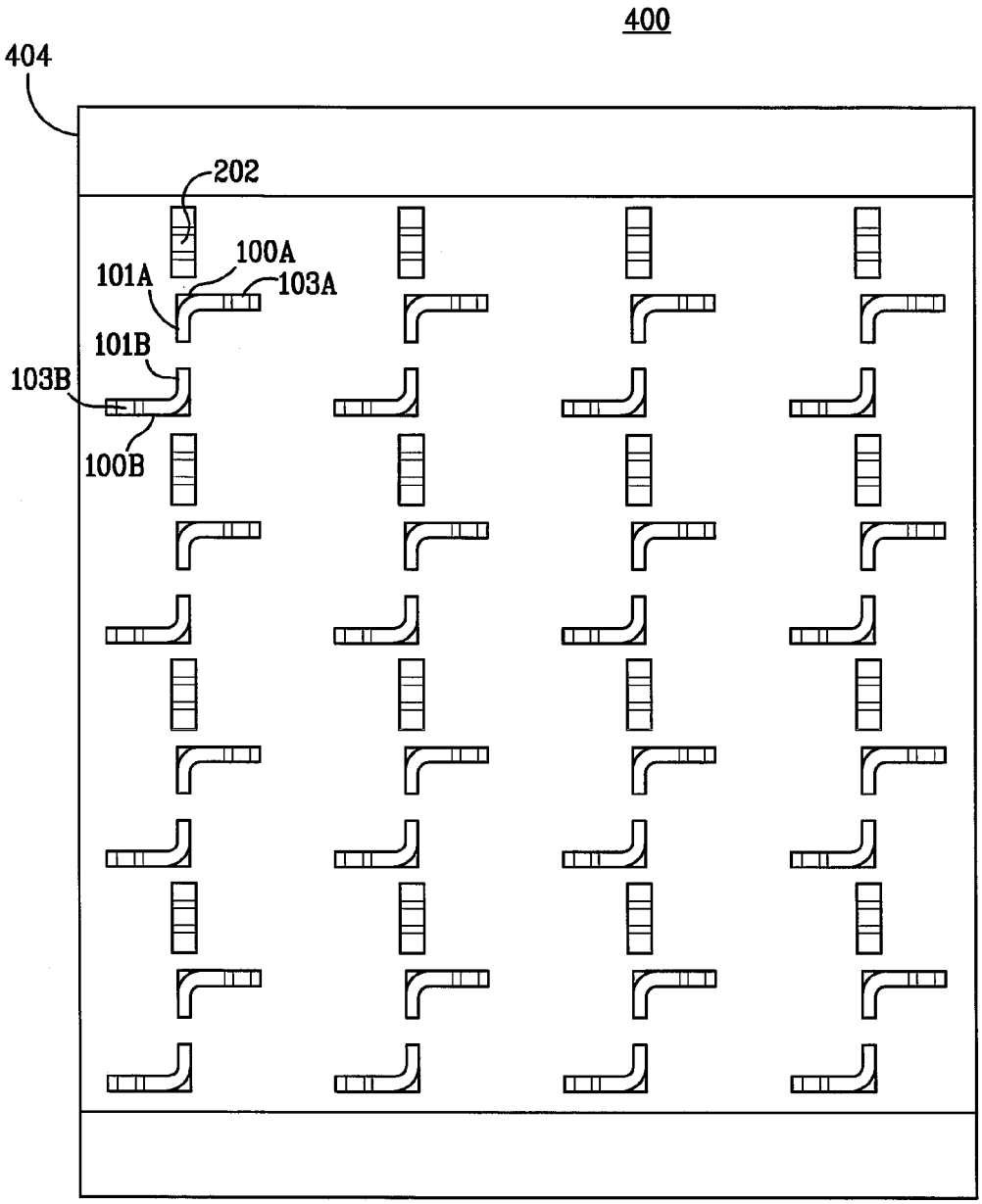
FIGS. 4A-C depict the bottom of an illustrative electrical connector in a wide configuration in bottom, close-up, and isometric views, respectively.
Figure 4B:
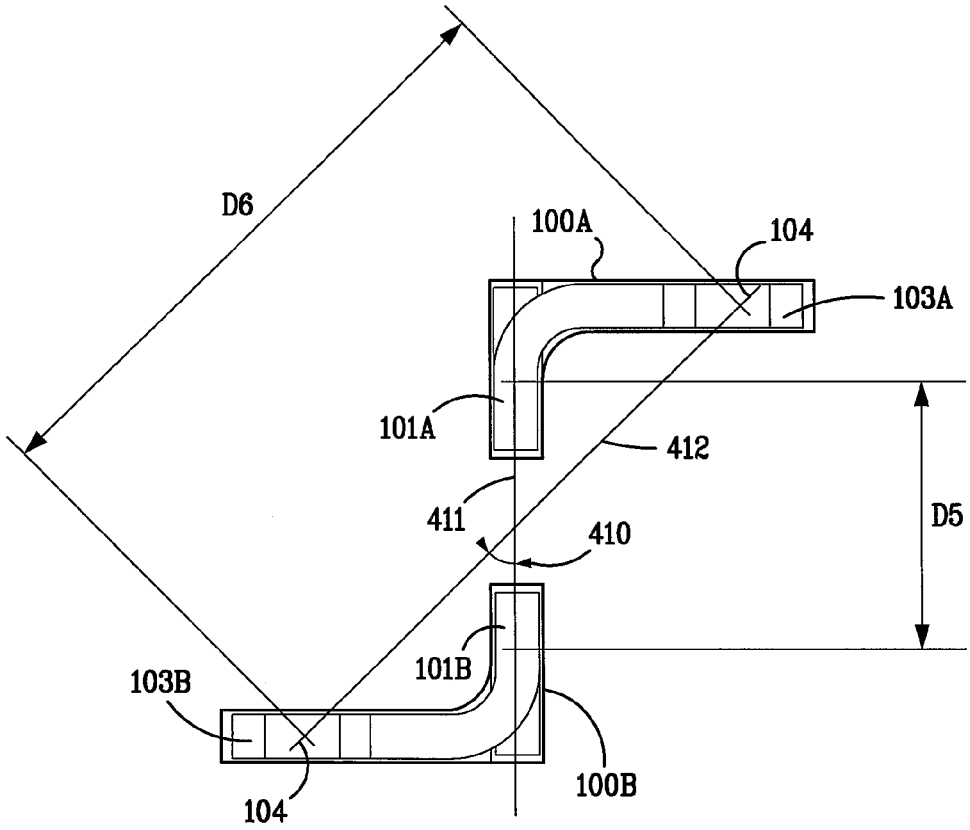
Figure 4C:
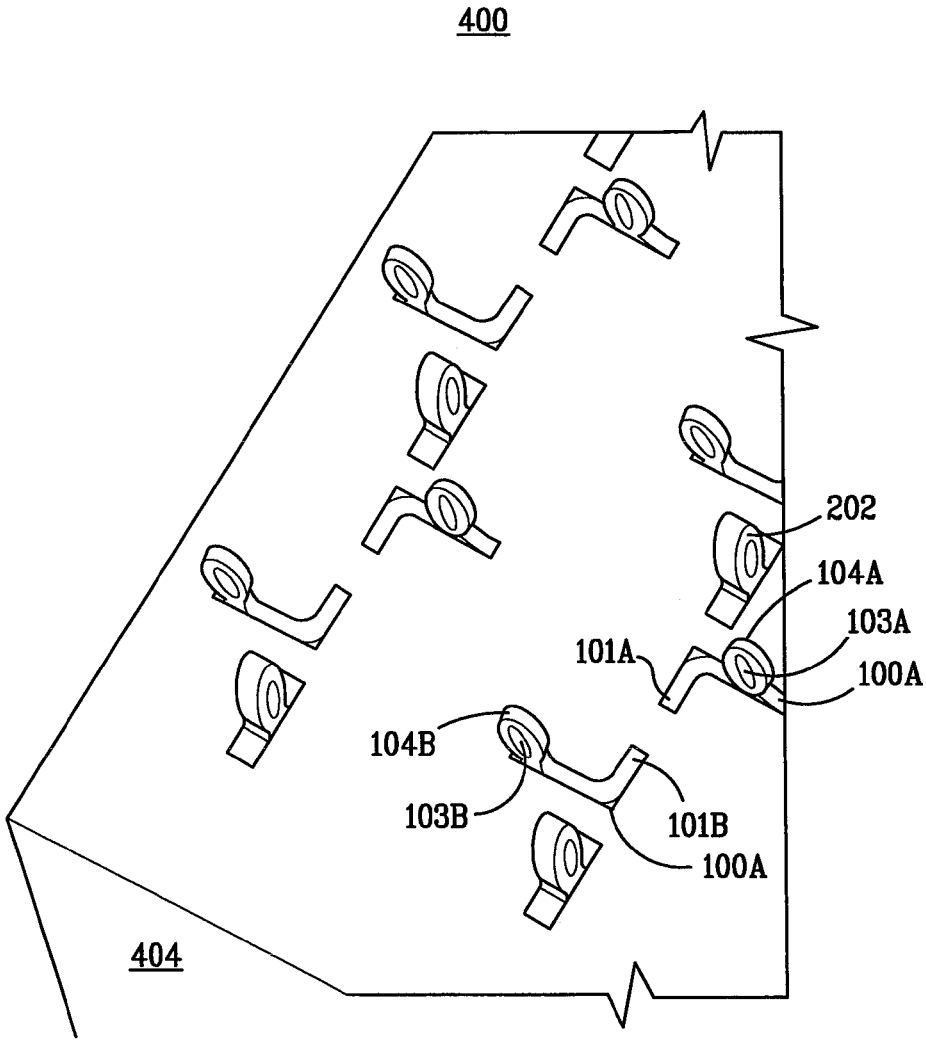

FIGS. 4A and 4B depict the bottom of an illustrative electrical connector 400 in a wide configuration in isometric and bottom views, respectively. Signal contacts 100A-B and ground contacts 202 may be secured within a connector housing 404. In this embodiment, each contact 100A-B within the signal pair may face away from each other. For example, the first contact 100A of the signal pair may be rotated 180° with respect to the second contact 100B of the signal pair such that their respective lead portions 101A-B are between the respective mounting portions 101A-B in a wide configuration.

Also suitable for an orthogonal application, the connector 400 may enable the lead portion 101A-B of each contact 100A-B to be oriented at a substantially 45° angle from the respective mounting portions 103A-B. For example, an imaginary contact plane 411 may align the lead portion 101A of the first contact 100A and the lead portion 101B of the second contact 100B. An imaginary line 412 may extend from the distal tip 104A of the mounting portion 103A of the first contact 100A to distal tip 104B of the mounting portion 103B of the second contact 100B. The contact plane and the imaginary line may interest at an angle 410. The angle 410 measured normal to the contact plane may be substantially 45°. The angle may be substantially 45° within manufacturing tolerance.

Distance D5 may be defined as the distance measured along the contact plane between the center of the lead portion 101A of the first contact 100A and the center of the lead portion 101B of the second contact 100B. Distance D5 may measure the contact pitch as measured center-to-center.

Distance D6 may be defined as the length of the imaginary line 412. Distance D6 may be selected independent of distance D5 such that the angle 110 is maintained. Thus, the distance D6 may be selected according to signal integrity and/or physical design requirements, while maintaining the geometry suitable for orthogonal applications. Because distance D6 may be selected independent of distance D5, connectors of the same family, where contact pitch is defined for the connector family, may be manufactured for specific applications such that distance D6 may be selected to match the impedance of a specific complementary electrical device. In the configuration shown, D6 may represent the maximum hole-to-hole spacing for an orthogonal application with a D5 contact pitch. Such a configuration may increase impedance.

Figure 5:
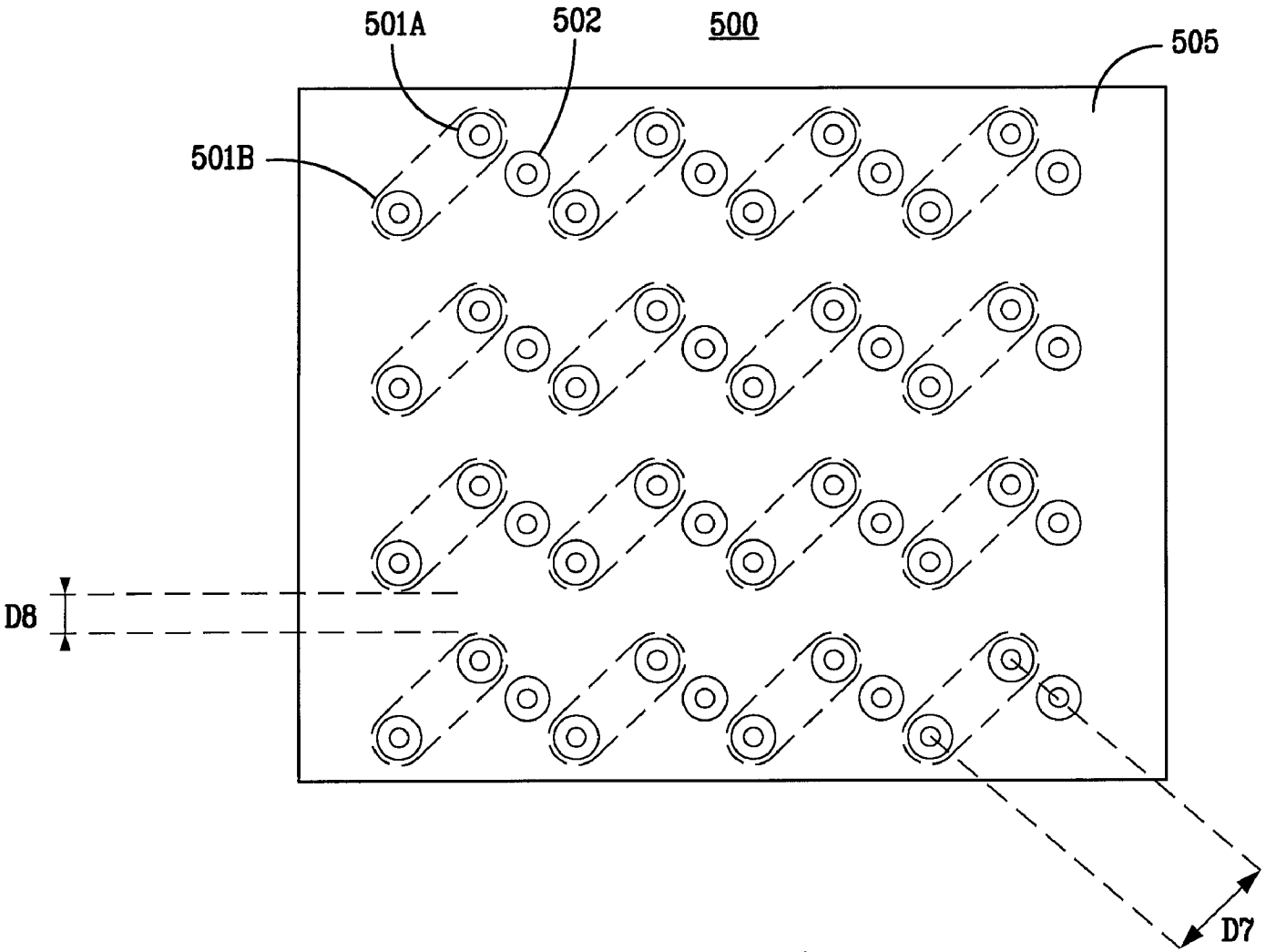
FIG. 5 depicts a illustrative circuit board layout for a wide configuration.

FIG. 5 depicts a illustrative circuit board layout 500 for a wide configuration. Vias 501A-B, 502 may holes in the circuit board 505 oriented for mounting connector 400. For example, via 502 may be a hole within the circuit board 505 that receives the mounting portion of the ground contact 202, and via 501A-B may be a hole within the circuit board 505 that receives mounting portion 103A-B of the signal contacts 100A-B.

The circuit board layout 500 may define a distance D7 between vias 501A-B. Distance D7 may match the distance D6. It may be desirable to select D7 on the basis of signal integrity. For example, it may be desirable to select D7 on the basis of impedance matching.

The circuit board layout 505 may define a distance D8 between rows of vias 501A-B. Distance D8 may provide a width of circuit board that may be used for conductive traces (not shown). It may be desirable to select D8 to ensure adequate physical space for conductive traces. Accordingly, design requirements that influence distance D7 and distance D8 may reflect various implementations for distance D6 of the electrical connector.

Figure 6C:
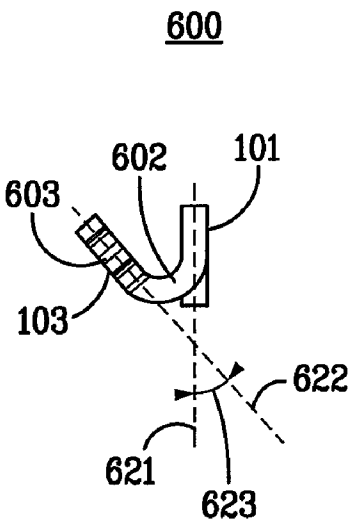
FIGS. 6A-C depict an illustrative electrical contact in front, side, and bottom views, respectively.
Figure 6B:
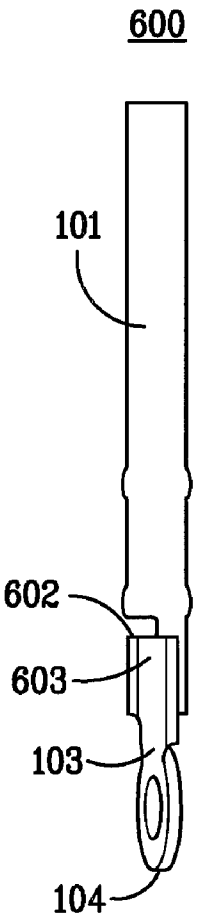
Figure 6A:
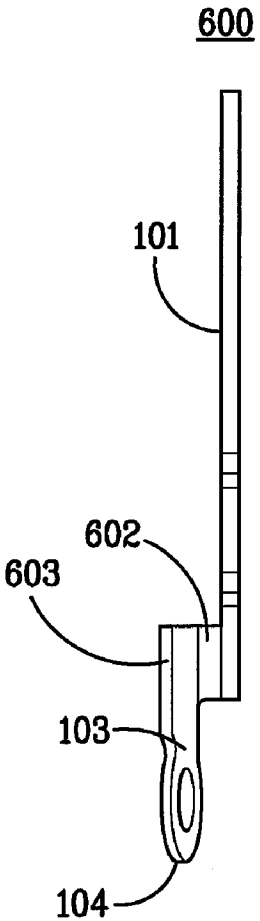

FIGS. 6A and 6B depict an illustrative electrical contact 600 in front, side, and bottom views respectively. The contact 600 may be used for a variable width configuration. The contact may include a lead portion 101 connected to an offset portion 602. The offset portion 602 may define a distal end 603. A mounting portion 103 may extend from the distal end 603 of the offset portion 602. The lead portion 101 and the mounting portion 103 may each define a longitudinal axis. The offset portion 602 may define the distance and relative position of the two axes. The offset portion 602 may be curved. The lead portion 101 may extend in a direction opposite the direction that the mounting portion 103 extends.

The lead portion 101 may define a first imaginary plane 621. The distal end 603 of the offset portion 602 may define a second imaginary plane 622. The first imaginary plane 621 and the second imaginary plane 622 may intersect at an angle 623. The angle 623 may be a non-right, acute angle, for example.

Figure 7A:
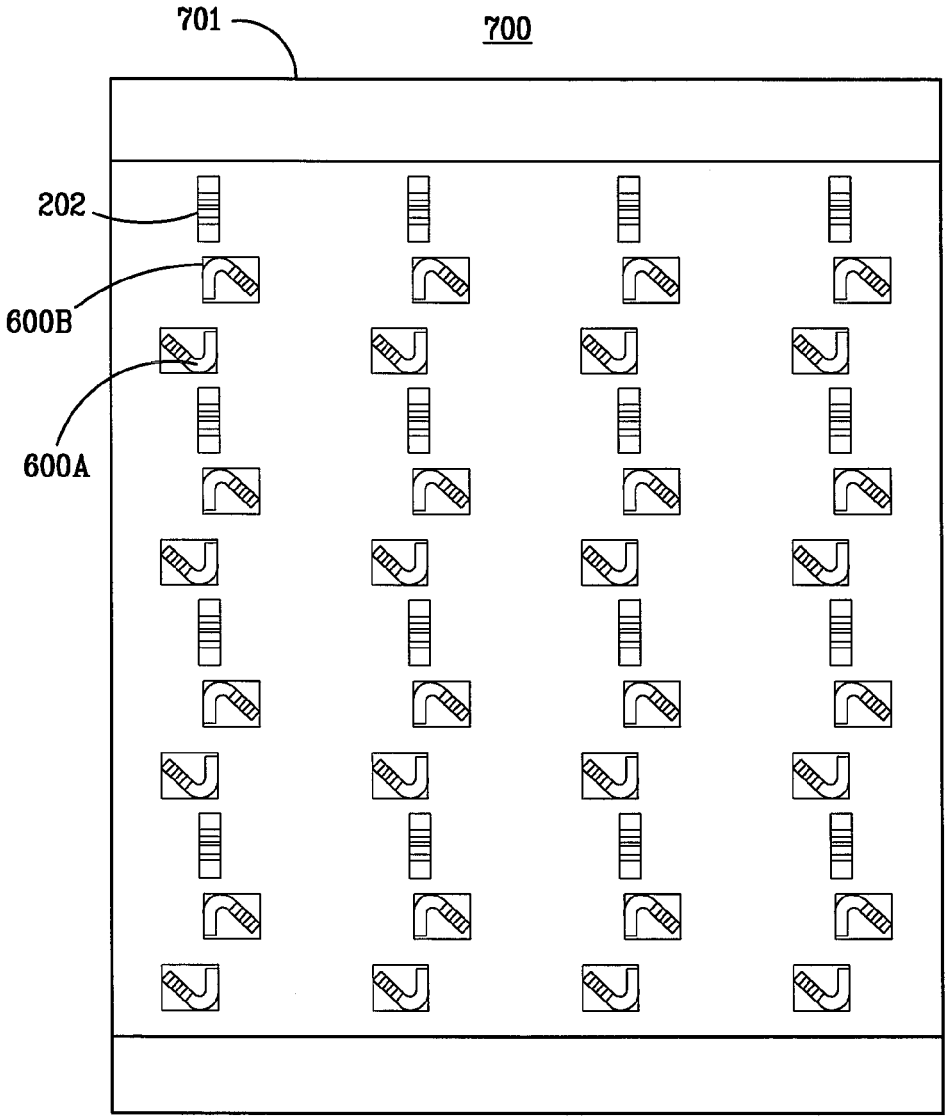
FIGS. 7A-B depicts the bottom of an illustrative electrical connector in an intermediate configuration in bottom and close-up views, respectively.
Figure 7B:
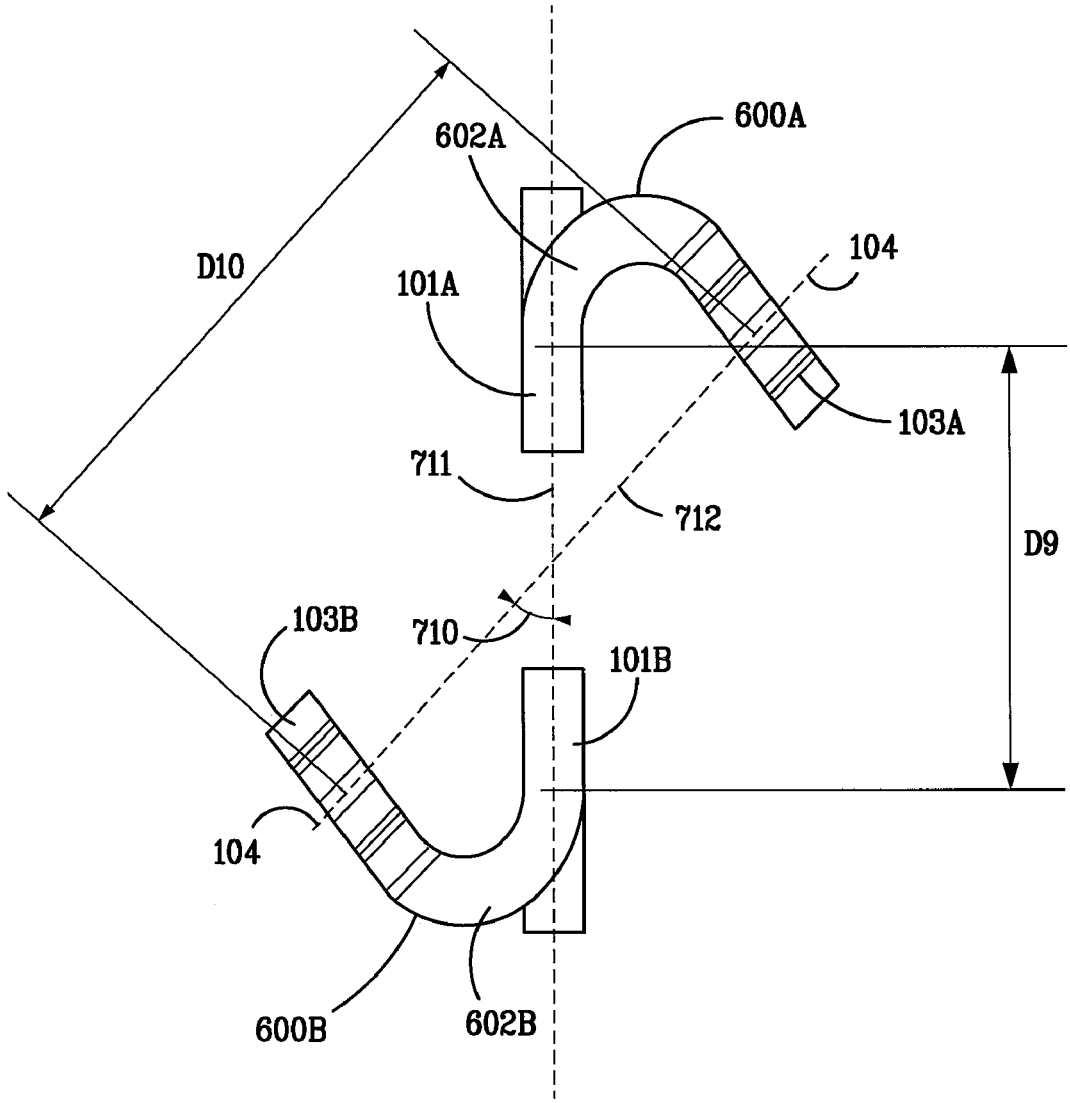

FIGS. 7A-B depicts the bottom of an illustrative electrical connector 700 in an intermediate configuration in bottom and close-up views, respectively. Signal contacts 600A-B and ground contacts 202 may be secured within a connector housing 701. Suitable for an orthogonal application, the connector 700 may enable the lead portion 101A-B of each contact 100A-B to be oriented at a substantially 45° angle from the respective mounting portions 103A-B. For example, an imaginary contact plane 711 may align the lead portion 101A of the first contact 100A and the lead portion 101B of the second contact 100B. An imaginary line 712 may extend from the distal tip 104A of the mounting portion 103A of the first contact 100A to distal tip 104B of the mounting portion 103B of the second contact 100B. The contact plane and the imaginary line may interest at an angle 710. The angle 710 measured normal to the contact plane may be substantially 45°. The angle may be substantially 45° within manufacturing tolerance.

Distance D9 may be defined as the distance measured along the contact plane between the center of the lead portion 101A of the first contact 100A and the center of the lead portion 101B of the second contact 100B. Distance D9 may measure the contact pitch as measured center-to-center.

Distance D10 may be defined as the length of the imaginary line 712. Distance D9 may be selected independent of distance D10 such that the angle 710 is maintained. Thus, the distance D10 may be selected according to signal integrity and/or physical design requirements, while maintaining the geometry suitable for orthogonal applications. Because distance D10 may be selected independent of distance D9, connectors of the same family, where contact pitch is defined for the connector family, may be manufactured for specific applications such that distance D10 may be selected to match the impedance of a specific complementary electrical device. D10 may be selected to be greater than, equal to, or less than D9.

In this configuration, D10 may represent an intermediate hole-to-hole spacing. D10 may be changed by varying the offset portion 602, resulting in variations in impedance, cross-talk, and routing channel width independent of the contact pitch D9.

What is claimed is:

1. An electrical connector comprising:

a connector housing having secured therein a first electrical contact and a second electrical contact, the first and second electrical contacts each comprising, a respective lead portion that defines a first imaginary plane;

a respective offset portion that extends from an end of the respective lead portion, the offset portion having a distal end that defines a second imaginary plane; and a respective mounting portion that extends from the distal end of the offset portion, the mounting portion defining a distal tip, the second imaginary plane forming an angle with the first imaginary plane, wherein the lead portion of the first contact aligns with the lead portion of the second contact to define an imaginary contact plane that forms a 45-degree angle, measured normal to the contact plane, with an imaginary line extending from the distal tip of the mounting portion of the first contact to the distal tip of the mounting portion of the second contact.

2. The electrical connector of claim 1, wherein each of the lead portions defines a respective first longitudinal axis extending along a respective first direction, and each of the offset portions extends from the end of the respective lead portion orthogonally to the first direction.

3. The electrical connector of claim 2, wherein each of the distal ends of the respective offset portions defines a respective second longitudinal axis extending along a second direction, and each of the mounting portion extends from the distal end of the respective offset portion orthogonally to the second direction.

4. The electrical connector of claim 3, wherein each respective first direction is orthogonal to the respective second direction.

5. The electrical connector of claim 1, where a distance between the mounting portion of the first contact and the mounting portion of the second contact is selected to match the impedance of a complementary electrical device to which the connector is adapted to be electrically coupled.

6. The electrical connector of claim 1, wherein each of the offset portions is curved.

7. The electrical connector of claim 1, wherein the connector housing comprises a mounting face for mounting the connector to a substrate, the offset portion of the first electrical contact is flush with the mounting face of the connector housing, and the offset portion of the second electrical contact is flush with the mounting face of the connector housing.

8. An electrical connector comprising:

a connector housing having secured therein a first electrical contact and a second electrical contact, the first and second electrical contacts each comprising, a respective lead portion that defines a first imaginary plane;

a respective offset portion that extends from an end of the lead portion, the offset portion having a distal end that defines a second imaginary plane; and a respective mounting portion that extends from the distal end of the respective offset portion, the mounting portion defining a distal tip thereof, wherein the lead portion of the first contact aligns with the lead portion of the second contact to define an imaginary contact plane that forms a 45-degree angle, measured normal to the contact plane, with an imaginary line extending from the distal tip of the mounting portion of the first contact to the distal tip of the mounting portion of the second contact;

wherein a first distance defined between the center of the lead portion of the first contact and the center of the lead portion of the second contact is different from a second distance defined between the distal tip of the mounting portion of the first contact and the distal tip of the mounting portion of the second contact projected normal to the contact plane.

9. The electrical connector of claim 8, where the distance between the mounting portion of the first contact and the mounting portion of the second contact is selected to match the impedance of a complementary electrical device.

10. The electrical connector of claim 8, wherein the connector housing comprises a mounting face for mounting to a substrate, the offset portion of the first contact is flush with the mounting face of the connector housing, and the offset portion of the second contact is flush with the mounting face of the connector housing.

11. The electrical contact of claim 8, wherein the offset portions are curved.

12. The electrical contact of claim 8, wherein each mounting portion defines an eye-of-the-needle configuration.

13. The electrical contact of claim 8, wherein the first distance is greater than the second distance.

14. The electrical contact of the claim 8, wherein the first distance is less than the second distance.

* * * * *